United States Patent [19]

Narazaki

[11] Patent Number: 4,620,734

[45] Date of Patent: Nov. 4, 1986

[54] DOOR LOCKING MECHANISM

[75] Inventor: Toshiharu Narazaki, Fuchu, Japan

[73] Assignee: Ryobi Limited, Hiroshima, Japan

[21] Appl. No.: 723,051

[22] Filed: Apr. 15, 1985

[30] Foreign Application Priority Data

Apr. 19, 1984 [JP] Japan ..... 59-58153[U]

[51] Int. Cl.[4] ..... E05C 1/06

[52] U.S. Cl. ..... 292/142; 292/150

[58] Field of Search ..... 70/143, 380; 292/150, 292/268, 269, 270, 142, 172

[56] References Cited

U.S. PATENT DOCUMENTS

| | | | |
|---|---|---|---|
| 2,275,362 | 3/1942 | Golden et al. | 70/380 X |
| 3,458,226 | 7/1969 | Carlston | 292/268 |
| 3,844,592 | 10/1974 | Giardina et al. | 292/39 |
| 3,990,278 | 11/1976 | Perelson | 70/120 |

FOREIGN PATENT DOCUMENTS 59-40455 3/1984 Japan .

*Primary Examiner*—Richard E. Moore

*Attorney, Agent, or Firm*—Frishauf & Partners

[57] ABSTRACT

A door locking mechanism which comprises a key body to be secured to the hem of a door, a slide key slidably mounted in the key body, the head of the slide key being protrudable out of the key body toward a door frame upon rotation of a locking knob so as to be shifted to its half-locked and complete-locked positions, a key latch to be secured to the door frame, and a half-locking arm anchored to the key latch and provided with an opening to receive the head of the slide key, wherein a pair of inlets are formed on the slide key and one of a pair of pins provided on the locking knob selectively engage one of the pair of inlets on the slide key to force the slide key to slide toward the door frame upon rotation of the locking knob, and a slide plate is vertically slidably mounted inside the key body and biased to hold the pins of the locking knob in a position where the pins disengage with the one of the inlets on the slide key, the slide plate being provided with means for positioning the slide key to its unlocked, half-locked and complete-locked positions.

5 Claims, 17 Drawing Figures

DOOR LOCKING MECHANISM

BACKGROUND OF THE INVENTION

This invention relates to a door locking mechanism, and more particularly the door locking mechanism which can be shifted among its unlocked, half-locked and complete-locked conditions. In its half-locked condition, the door may open in a limited range but a person is not allowed to go in and out.

One of the prior locking mechanisms of this kind is disclosed in Japanese laid-open utility model No. 59-40455(1984). This mechanism comprises a key body to be secured to the hem of a door, a slide key slidably mounted in the key body, the head of the slide key being protrudable out of the key body toward a door frame so as to be shifted to its half-locked and complete-locked positions, a keeper to be secured to the door frame, and a half-locking arm anchored to said key latch and provided with an opening to receive the head of the slide key.

With this mechanism, by shifting the head of the slide key to its half-locked position, it is received only in the opening of the half-locking arm. In this condition, the door may open but the half-locking arm restricts the opening angle of the door within the length of the arm.

By shifting the head of the slide key to its complete-locked position, it is received in the recess of the door frame as well as in the opening of the half-locking arm. In this condition, the door may not open as the head of the slide key is caught by the door frame.

In this mechanism, the slide key is shifted by rotating a locking knob mounted on the key body. The locking knob is provided with a pair of pins oppositely arranged in a radial direction and protruded inwardly of the key body. A swinging plate is mounted inside the key body and one end of the swinging plate is pivoted on the slide key. The swinging plate is provided with a plurality of inlets at the lower edge thereof to be selectively engaged by the pair of pins of the locking knob. By rotating the locking knob, the pair of pins rotate in the same direction and the swinging plate is swung and moved in the sliding direction of the slide key until the pair of pins engage the other inlets of the swinging plate. Thus, the slide key is shifted among its unlocked, half-locked and complete-locked positions.

With the above described prior mechanism, however, as the swinging plate is utilized to convert and transmit the rotary motion of the locking knob into the sliding movement of the slide key, the length of the key body in the sliding direction of the slide key becomes long. Accordingly, it is impossible to secure the key body on the hem of the door in case the hem of the door is narrow.

SUMMARY OF THE INVENTION

Accordingly, it is an object of the invention to provide an improved door locking mechanism wherein the length of a key body in the sliding direction of a slide key is reduced so that the key body is able to be secured to a door even though the hem of a door is narrow.

For this purpose, the invention provides a door locking mechanism which comprises a key body to be secured to the hem of a door, a slide key slidably mounted in said key body, the head of said slide key being protrudable out of the key body toward a door frame upon rotation of a locking knob so as to be shifted to its half-locked and complete-locked positions, a keeper to be secured to the door frame, and a half-locking arm anchored to said keeper and provided with an opening to receive to head of the slide key, characterized in that a pair of inlets are formed on said slide key and one of a pair of pins provided on said locking knob selectively engage one of said pair of inlets on the slide key to force the slide key to slide toward the door frame upon rotation of the locking knob, and that a slide plate is vertically slidably mounted inside the key body and biased to move in the direction to prevent the engagement of the pins of the locking knob with said one of the inlets on the slide key.

EMBODIMENTS OF THE INVENTION

Figure 1:
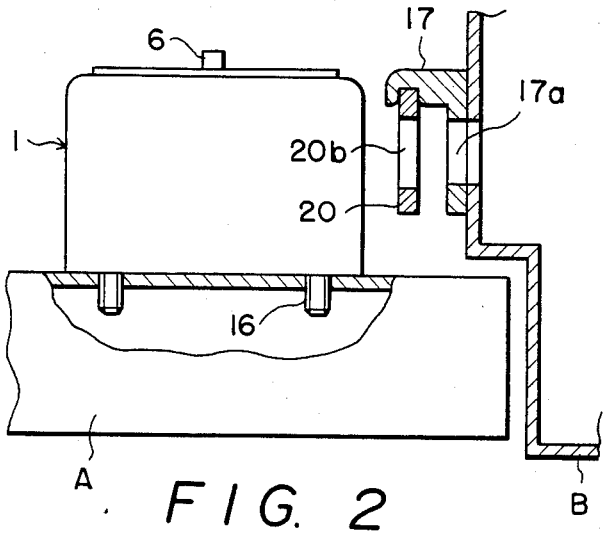
FIG. 1 is a partly-cut plan view of the door locking mechanism embodying the invention wherein the mechanism is in its unlocked condition.
Figure 2:
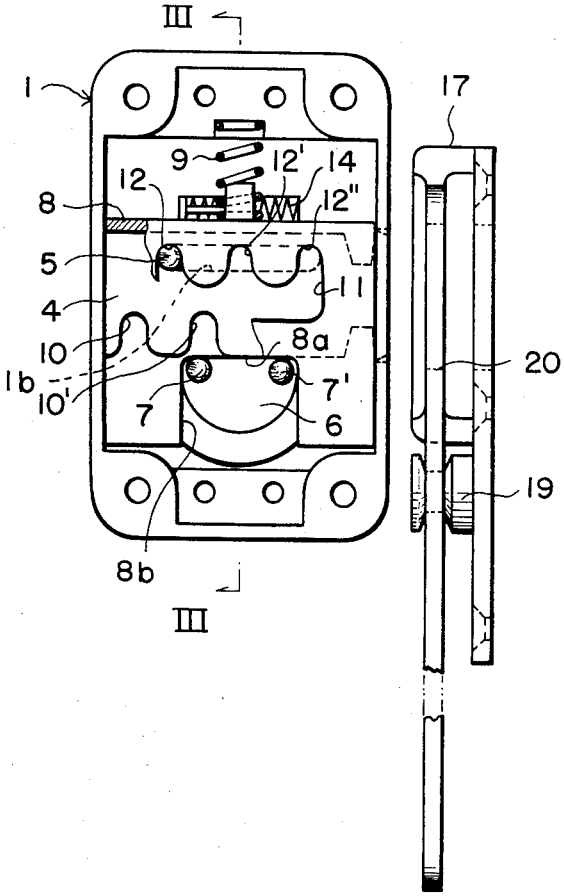
FIG. 2 is a rear view of the door locking mechanism shown in FIG. 1 wherein a rear cover plate is omitted.
Figure 3:
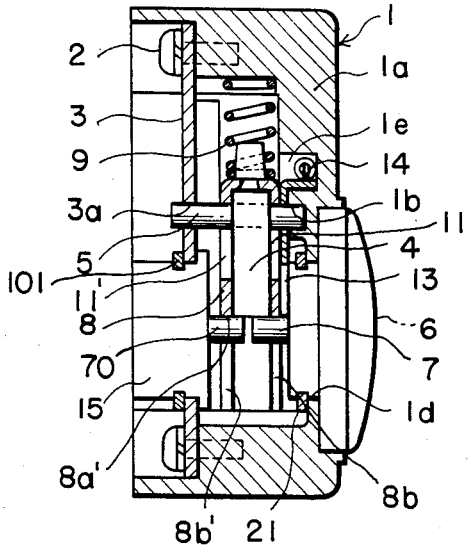
FIG. 3 is a sectional view taken along the line III—III in FIG. 2.

A locking mechanism embodying the invention illustrated in FIGS. 1 through 3 comprises a key body 1 and a half-locking arm 20.

In the key body 1, the rear side of which is closed by a cover plate 3, and slide key 4 is laterally slidably mounted. The front end of the slide key 4 is protrudable out of the key body 1 through an opening 1*c* formed at one side of the key body 1.

A guide pin 5 is secured to the slide key 4 in such a manner that the guide pin 5 passes through the slide key 4 in the direction perpendicular to the sliding direction of the slide key 4. The front end of the guide pin 5 is slidably received in a laterally extending recess 1*b* formed on the inner side of the front wall 1*a* of the key body 1. The rear end of the guide pin 5 is slidably received in a laterally extending slot 3*a* formed on the cover plate 3.

A locking knob 6 is inserted through an opening 1*d* formed on the front wall 1*a* and rotatably supported by a stop ring 21 so as not to be dislocated from the front wall 1*a*. A pair of pins 7—7′ which are arranged radially symmetrically are inwardly projected from the rear side of the locking knob 6. The rotary center of the locking knob 6 is positioned just below the lower edge of the slide key 4. At the lower edge of the slide key 4, a pair of downwardly opened inlets 10—10′ are formed at the interval corresponding to that of the pair of pins 7—7′ of the locking knob 6, so that one of the pins 7—7′ selectively engages one of the inlets 10—10′ upon the rotation of the locking knob 6.

A rotary member 15 opposed to the locking knob 6 is inserted through an opening formed on the rear cover plate 3 and rotatably supported by a stop ring 101 so as not to be dislocated from the rear cover plate 3. A pair of pins 70—70′ corresponding to the pins 7—7′ of the locking knob 6 are inwardly projected from the inner side of the rotary member 15. The rotary member 15 is utilized as another locking knob to operate the slide key 4 from outside the door. Upon the rotation of the rotary member 15, one of the pins 70—70′ selectively engages one of the inlets 10—10′ of the slide key.

A slide plate 8 having an inverted-U shaped cross-section is vertically slidably mounted in the key body 1 in such a manner that the slide plate 8 straddles the slide key 4. The slide plate 8 is downwardly biased by a spring 9 arranged between the upper end of the slide plate 8 and the inner side of the upper wall of the key body 1. A pair of downwardly opened inlets 8*b*—8*b*′ are formed at the lower side of the front and rear walls of the slide plate 8 so as to receive the pins 7—7′ of the locking knob 6 and the pins 70—70′ of the rotary member 15 therein, respectively. Thus, the slide plate 8 downwardly biased by the spring 9 is maintained at a position where the upper edges 8*a*—8*a*′ thereof contact the pins 7—7′ of the locking knob 6 and the pins 70—70′ of the rotary member 15.

A pair of opposed openings 11—11′ are formed on the front and rear walls of the slide plate 8, through which the guide pin 5 of the slide key 4 passes. At the upper edge of the opening 11/11′, three downwardly opened inlets 12—12′—12″ are formed at the interval corresponding to that of pins 7—7′ so as to selectively receive the guide pin 5 upon the sliding movement of the slide key 4.

Figure 9:
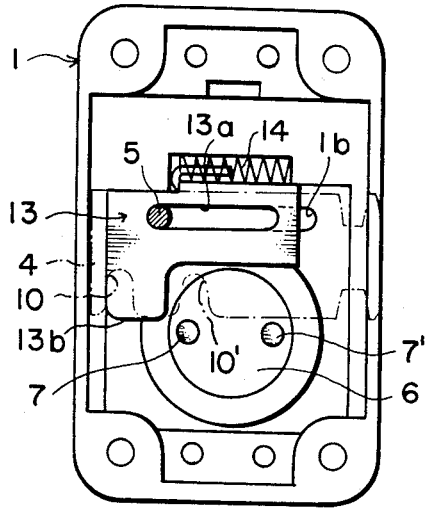
FIG. 9 is a rear view of the mechanism in its unlocked condition wherein a rear cover plate and a slide plate are omitted.
Figure 10:
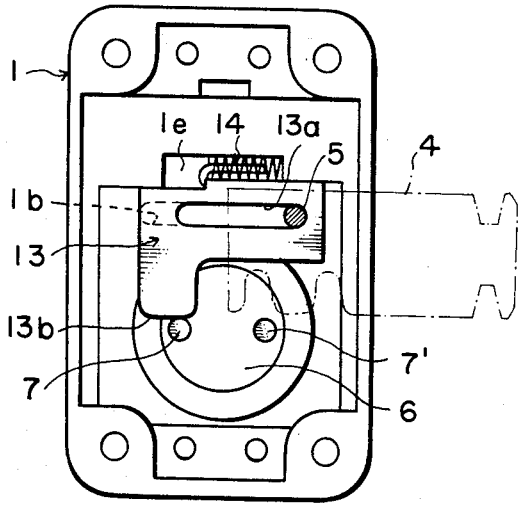
FIG. 10 is a rear view of the mechanism in its complete-locked position wherein a rear cover plate and a slide plate are omitted.

A stopper plate 13 is, as illustrated in FIGS. 3, 9 and 10, laterally slidably arranged between the front wall 1*a* of the key body 1 and the slide plate 8. The stopper plate 13 is biased in the left direction in FIG. 9 by a spring 14 received in the laterally extending recess 1*e* formed at the inner side of the front wall 1*a* of the key body 1. A laterally extending slot 13*a* is formed on the stopper plate 13, through which the guide pin 5 of the slide key 4 passes. The stopper plate 13 has the converted-L shaped configuration and the slot 13*a* is provided on the laterally extending leg thereof, so that the stopper plate 13 does not disturb the rotation of pins 7—7′ of the knob 6. The other leg of the stopper plate 13 extends downwardly until it reaches around the rotary center of the locking knob 6.

Figure 11:
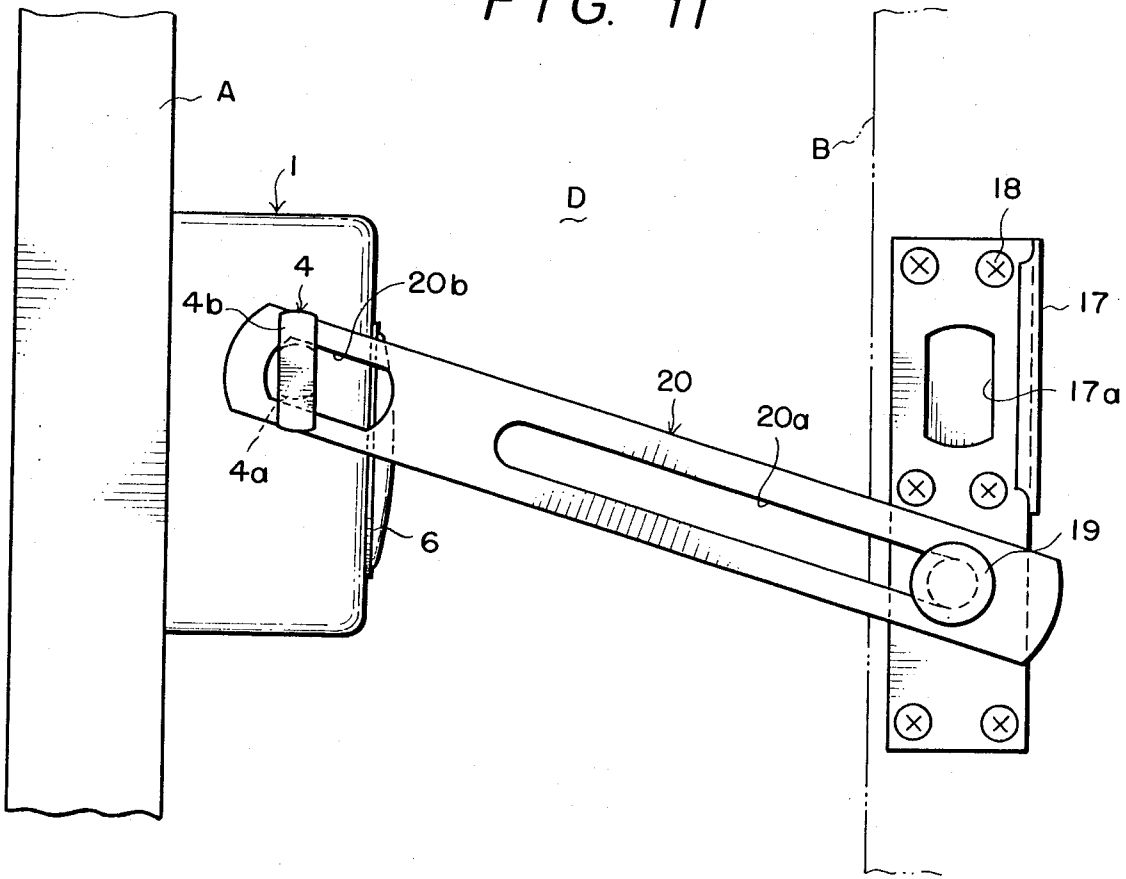
FIG. 11 is a side view of the mechanism in its half-locked condition.

A keeper 17 is secured to a door frame B by screws 18, as illustrated in FIGS. 1, 2, and 11, in such a manner that an opening 17*a* formed on the keeper 17 receives a head 4*b* of the slide key 4 therein.

A locking arm 20 is rotatably slidably connected to a hook 19 provided on the keeper 17, as illustrated in FIGS. 2 and 11, by engaging the hook 19 with a longitudinally extending slot 20*a* formed on the locking arm 20. An opening 20*b* is provided at the upper end of the locking arm 20 so as to be engaged with the head 4*b* of the slide key 4. The slot 20*b* is positioned to be consistent with the slot 17*a* of the keeper 17 when the locking arm 20 is in a vertically straight position as shown in FIG. 2.

The head 4*b* of the slide key 4 is provided with a reduced-diameter portion 4*a*, on which the arm 20 is engaged. The vertical lengths of the openings 20*b* and 17*a* are prepared to be slightly larger than that of the slide key 4, but the lateral lengths of the openings 20*b* and 17*b* are to be smaller than the vertical length of the slide key 4. Accordingly, when the arm 20 is rotated around the reduced-diameter portion 4*a* of the slide key 4, the arm 20 is not able to be dislocated from the slide key 4.

The above described mechanism operates as follows.

In FIGS. 1, 2, 3 and 9, the locking mechanism is in its unlocked condition. Under this condition, the slide plate 8 is downwardly pressed by the spring 9 until its downward movement is prevented by the pins 7—7′ of the locking knob 6 as well as the pins 70—70′ of the rotary member 15. At this stage, the pins 7—7′/70—70′ are in horizontally parallel state along the upper edge 8*a*/8*a*′ of the slide plate 8, and the guide pin 5 is received in the leftmost inlet 12/12 of the opening 11/11′ of the slide plate 8. The head 4*b* of the slide key 4 is maintained inside the key body 1 so that the door A is free to open. Further, the half-locked arm 20 is maintained at its vertically straight position by its self-weight.

Figure 4:
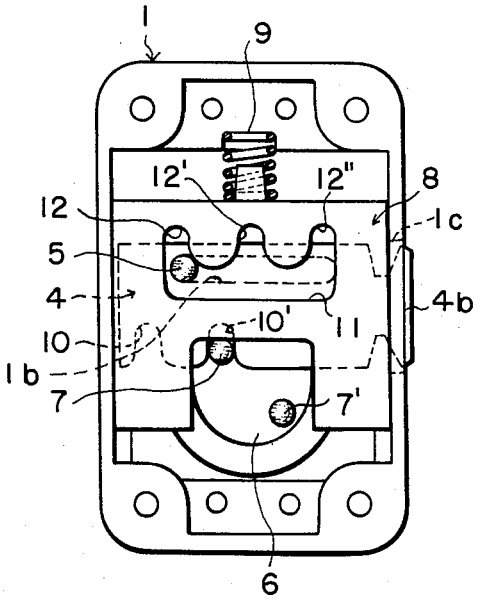
FIG. 4 is a rear view of the door locking mechanism showing its operating state.

When the locking knob 6 is rightwardly rotated, in FIG. 2 where the locking mechanism is in its unlocked condition, the pin 7 upwardly pushes the edge 8*a* of the slide plate 8. Thereby, the slide plate 8 is moved upwardly against the biasing force of the spring 9, and the guide pin 5 is released from the inlet 12/12 of the slide plate 8 and falls into the opening 11/11′ thereof. Simultaneously, the pin 7 of the locking knob 6 engages the right inlet 10′ of the slide key 4 so as to force the slide key 4 to rightwardly slide in FIG. 4.

Figure 5:
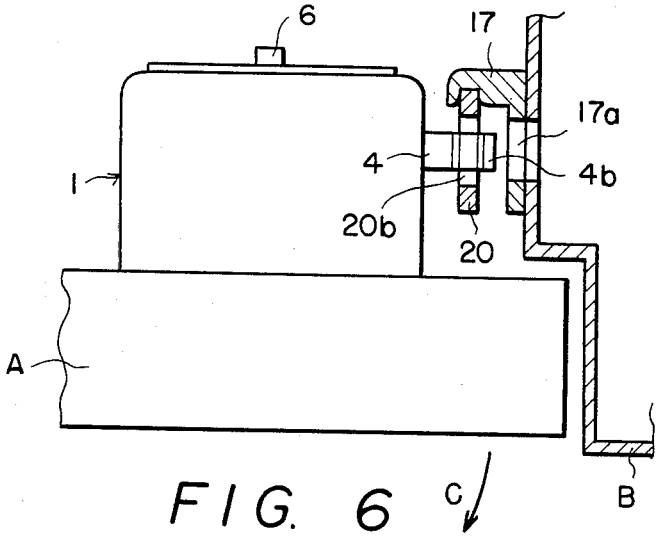
FIG. 5 is a plan view of the door locking mechanism wherein the mechanism is in its half-locked condition.
Figure 6:
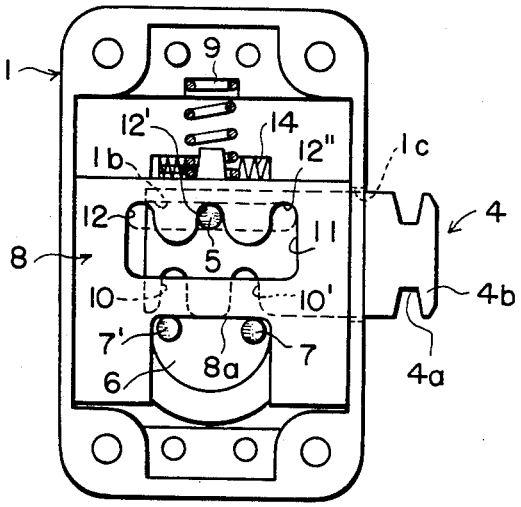
FIG. 6 is a rear view of the mechanism shown in FIG. 5.
Figure 7:
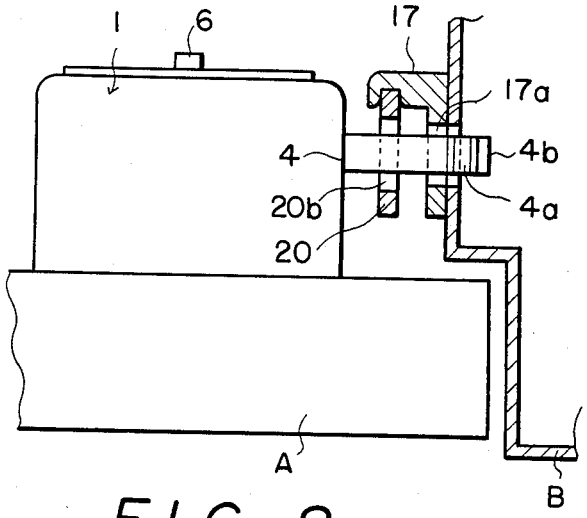
FIG. 7 is a plan view of the mechanism in its complete-locked condition.

Upon rotating at the angle of 180°, the pin 7 is released from the inlet 10′ and the pair of pins 7—7′ are positioned in holizontally parallel state, as shown in FIG. 6. At this stage, the slide plate 8 is downwardly moved by the biasing force of the spring 9 and the guide pin 5 is received in the inlet 12′/12′. Thus, the slide key 4 is maintained in its half-locked position, as illustrated in FIGS. 5 and 6.

When the slide key 4 is in its half-locked position, the door A can open within the predetermined spacing D, as illustrated in FIG. 11, as the half-locking arm 20 is pulled by the slide key 4 upon opening the door A and the arm 20 is swung about the hook 19 of the keeper 17 until the lower end of the slot 20*a* contacts the hook 19. At this time, the opening 20*b* of the arm 20 is rotated relative to the head 4*b* of the slide key 4 about the reduced-diameter portion 4*a*, so that the arm 20 is not dislocated from the slide key 4.

Figure 8:
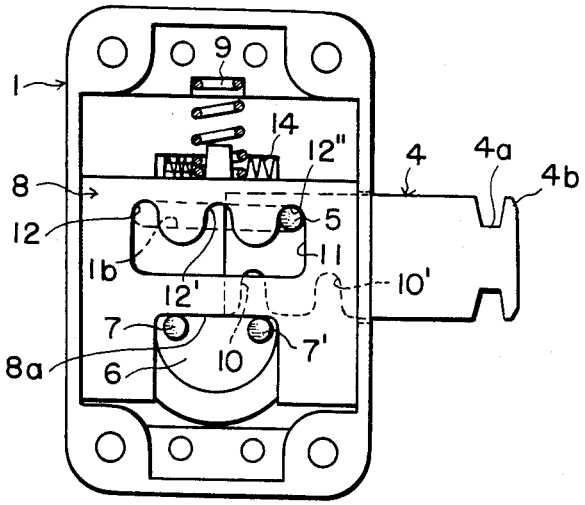
FIG. 8 is a rear view of the mechanism shown in FIG. 7.

By closing the door A and further rotating the locking knob 6 in the clockwise direction at the angle of 180°, the slide plate 8 is pushed up by the another pin 7′ and the guide pin 5 is released from the inlet 12′/12′ so that the slide key 4 is rightwardly moved and further protruded out of the opening 1*c* of the body 1. When the pins 7—7′ are positioned in the horizontally parallel state, the plate 8 is downwardly moved and the guide pin 5 is received in the rightmost inlet 12″/12″ as shown in FIG. 8. At this state, the head 4*b* of the slide key 4 is received in both the opening 20*b* of the half-locking arm 20 and the opening 17*a* of the keeper 17. Thus, the locking mechanism is in its complete-locked condition.

Upon the above rotation of the locking knob 6 to shift the slide key 4 from its half-locked to complete-locked positions, the guide pin 5 contacts the slot 13*a* of the stopper plate 13 and the plate 13 is rightwardly moved against the biasing force of the spring 14. Finally, the lower edge 13*b* of the stopper plate 13 contacts the pin 7 of the locking knob 6 so as to prevent the further rightward rotation thereof. Thus, the further protrusion of the head 4*b* of the slide key 4 is prevented when the slide key 4 is in its complete locked position.

On the contrary, by rotating the locking knob 6 in the counter-clockwise direction, the slide key 4 is retracted to its half-locked and unlocked positions.

In the above described embodiment, the rear side wall of the slide plate 8 and the pair of pins 70—70′ may be omitted by interconnecting the rotary member 15 and the locking knob 6 so that the rotary motion of the rotary member 15 is transmitted to the locking knob 6.

Figure 12:
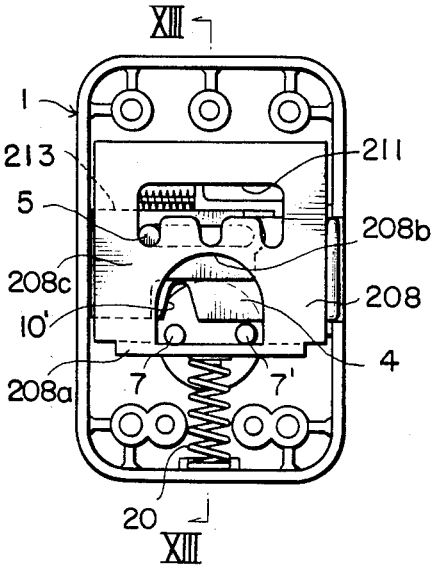
FIG. 12 is a rear view showing another embodiment of the invention wherein a rear cover plate is omitted.
Figure 13:
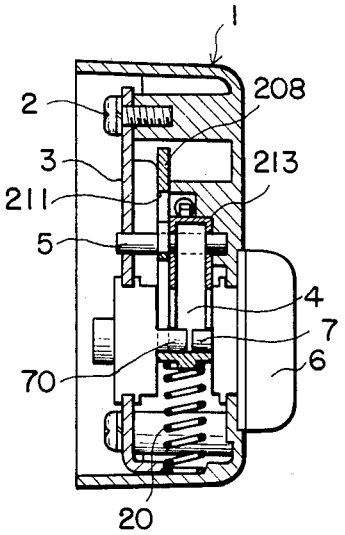
FIG. 13 is a sectional view taken along the line XIII—XIII in FIG. 12.
Figure 14:
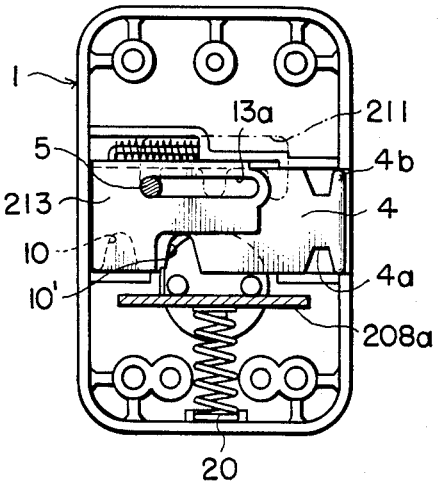
FIG. 14 is a rear view of the door locking mechanism shown in FIG. 12 wherein a slide plate is further omitted.

FIGS. 12 through 14 show another embodiment of the invention.

In this embodiment, a slide plate 208 is formed to have L-shaped cross section and is upwardly biased by a spring 209 arranged between the horizontal leg 208*a* and the inner side of the lower wall of the key body 1. A semicircular opening 208*b* is formed at the lower side of the vertical leg 208*c* to receive the pair of pins 7—7′/-70—70′ of the locking knob 6 and the rotary member 15, and allow the rotation thereof therein. Thus, the slide plate 208 upwardly biased by the spring 209 is maintained at a position where the horizontal leg 208*a* thereof contacts the pins 7—7′/70—70′.

An opening 211 is formed on the slide plate 208, through which the guide pin 5 of the slide key 4 passes. At the lower edge of the opening 11, three upwardly opened inlets 212—212′—212″ are formed so as to selectively receive the guide pin 5 upon the sliding movement of the slide key 4.

A stopper plate 213 is formed to have an inverted-U shaped cross section and arranged to straddle the slide key 4, as shown in FIG. 13.

The other construction is substantially same as the first embodiment described hereinbefore.

Figure 15:
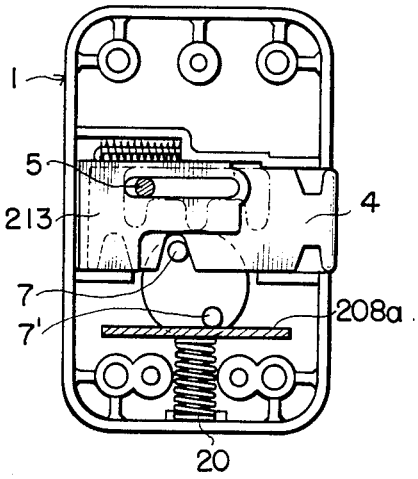
FIG. 15 is a rear view of the mechanism showing its operating state.
Figure 16:
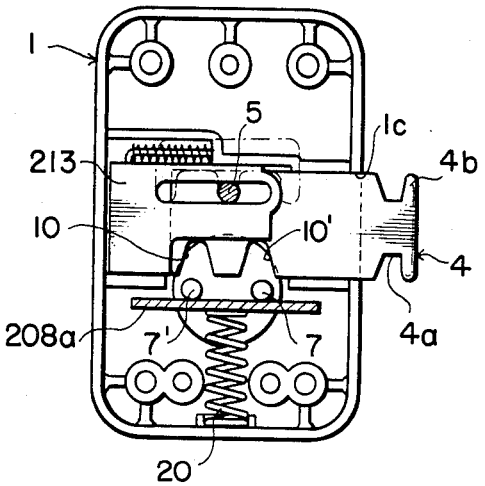
FIG. 16 is a rear view of the mechanism which is in the half-locked condition.

In this embodiment, when the locking knob 6 is rotated in the clockwise direction, in FIG. 12 where the locking mechanism is in its unlocked condition, the pin 7′ downwardly pushes the horizontal leg 208*a* of the slide plate 208. Thereby, the slide plate 8 is moved downwardly against the biasing force of the spring 209, and the guide pin 5 disengages the inlet 12 of the opening 11 of the slide plate 208. Simultaneously, the other pin 7 of the locking knob 6 engages the inlet 10′ of the slide key 4 so as to force the slide key 4 to rightwardly slide in FIG. 15. Upon rotating at the angle of 180°, the pin 7 is released from the inlet 10′ and the pair of pins 7—7′ are positioned in horizontally parallel state, as shown in FIG. 16. At this stage, the slide plate 208 is upwardly moved by a biasing force of the spring 209 and the guide pin is received in the intermediate inlet 12′ of the opening 11 of the slide key 4, thus the slide key 4 is maintained in its half-locked position.

Figure 17:
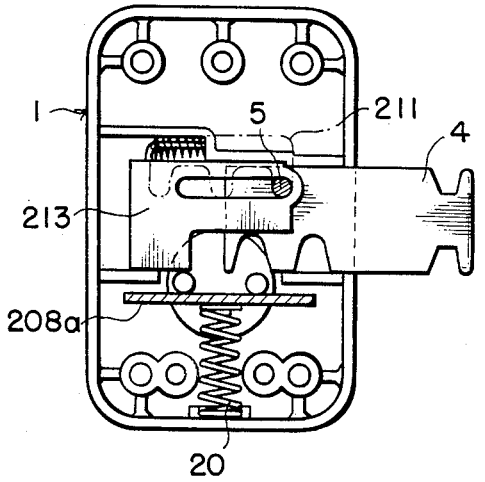
FIG. 17 is a rear view of the mechanism which is in the complete-locked condition.

By further rotating the locking knob 6 in the clockwise direction at the angle of 180°, the slide key 4 is moved to and maintained in its complete-locked position, as shown in FIG. 17. At this stage, the stopper plate 213 is moved to its rightest position and the lower edges of the stopper plate 213 contact the pin 7 of the locking knob 6 and the pin 70 of the rotary member 15 so as to prevent the further rotations of the locking knob 6 and the rotary member 15.

What is claimed is:

1. A door locking mechanism comprising:

a key body adapted to be secured to a hem of a door;

a slide key slidably mounted in said key body and selectively movable to any one of an unlocked position, a half-locked position, and a complete-locked position, and including a pair of inlets and first locating means to retain said slide key in any one of said positions;

a keeper secured to the door frame and having a recess in cooperating alignment along a given line with said slide key to receive therein a head of the slide key;

a half-locking arm rotatably and slidably secured to said keeper between said key body and said keeper and having an opening alignable between said slide key and said recess of the keeper and sized to accomodate the slide key head therein, the head of said slide key being substantially fully retracted into said key body in the unlocked position of said slide key, received only in said half-locking arm opening in the half-locked position, and received in said keeper recess in the complete-locked position, said half-locking arm being rotatable and slidable in a plane substantially perpendicular to the door in its closed position;

rotary means rotatably secured to said key body and including at least one pin thereon for selectively engaging said at least one pin into one of said pair of inlets and, when rotated, moving said slide key along said line;

a slide plate slidably mounted in said key body to move in a direction substantially perpendicular to said given line, and including second locating means cooperating with said first locating means for positioning said slide key in its unlocked, half-locked and complete-locked positions, said slide plate having an inverted-U shaped cross section and straddling said slide key with a portion thereof being engageable with said at least one pin; and biasing means between said key body and said slide plate for urging said slide plate to engage said at least one pin to thereby disengage said pin from said inlets.

2. The door locking mechanism according to claim 1 wherein said first locating means comprises a guide pin secured to said slide key so that its axis points in a direction perpendicular to said given line, and said second locating means comprises an opening having three inlets at the inner periphery thereof formed on said slide plate to selectively receive said guide pin so as to position and maintain the slide key at any of its unlocked, half-locked and complete-locked positions.

3. The door locking mechanism according to claim 1 wherein said stopper plate means has an inverted-U shaped cross section and straddles said slide key so as to prevent the rotation of said rotary means to further shift said slide key toward the door frame when the slide key is in its complete-locked position.

4. A door locking mechanism comprising:

a key body adapted to be secured to a hem of a door;

a slide key slidably mounted in said key body and selectively movable to any one of an unlocked position, a half-locked position, and a complete-locked position, and including a pair of inlets and first means to retain said slide key in any one of said positions;

a keeper secured to the door frame and having a recess in cooperating alignment along a given line to receive therein a head of the slide key with said slide key;

a half-locking arm rotatably and slidably secured to said keeper between said key body and said keeper and having an opening alignable between said slide key and said recess of the keeper, and sized to accomodate the slide key head therein, the head of said slide key being substantially fully retracted into said key body in the unlocked position of said slide key, received only in said locking arm opening in the half-locked position, and received in said keeper recess in the latched position, said half-locking arm being rotatable and slidable in a plane substantially perpendicular to the door in its closed position;

rotary means rotatably secured to said key body and including at least one pin thereon for selectively engaging said at least one pin into one of said pair of inlets and, when rotated, moving said slide key along said line;

a slide plate slidably mounted in said key body to move in a direction substantially perpendicular to said given line, and including second means cooperating with said first means for positioning said slide key in its unlocked, half-locked and complete-locked positions;

biasing means between said key body and said slide plate for urging said slide plate to engage said at least one pin to disengage said pin from said inlets; and an L-shaped stopper plate means arranged inside said key body to prevent the rotation of said rotary means to further shift said key toward the door frame when the slide key is in its complete-locked position.

5. A door locking mechanism comprising:

a key body adapted to be secured to a hem of a door;

a slide key slidably mounted in said key body and selectively movable to any one of an unlocked position, a half-locked position, and a complete-locked position, and including a pair of inlets and first means to retain said slide key in any one of said positions;

a keeper secured to the door frame and having a recess in cooperating alignment along a given line to receive therein a head of the slide key with said slide key;

a half-locking arm rotatably and slidably secured to said keeper between said key body and said keeper and having an opening alignable between said slide key and said recess of the keeper, and sized to accomodate the slide key head therein, the head of said slide key being substantially fully retracted into said key body in the unlocked position of said slide key, received only in said locking arm opening in the half-locked position, and received in said keeper recess in the latched position, said half-locking arm being rotatable and slidable in a plane substantially perpendicular to the door in its closed position;

rotary means rotatably secured to said key body and including at least one pin thereon for selectively engaging said at least one pin into one of said pair of inlets and, when rotated, moving said slide key along said line;

a slide plate slidably mounted in said key body to move in a direction substantially perpendicular to said given line, and including second means cooperating with said first means for positioning said slide key in its unlocked, half-locked and complete-locked positions;

biasing means between said key body and said slide plate for urging said slide plate to engage said at least one pin to disengage said pin from said inlets; and wherein said slide plate has an L-shaped cross-section and is upwardly biased by a spring arranged between the lower inner wall of said key body and a horizontal leg of the slide plate, said slide plate being moved downwardly upon the rotation of said rotary means against the biasing force of the spring.

* * * * *